US012465164B1

(12) United States Patent
Fischer

(10) Patent No.: US 12,465,164 B1
(45) Date of Patent: Nov. 11, 2025

(54) PACKAGE PROTECTION DEVICE

(71) Applicant: Matthew Fischer, Stanwood, WA (US)

(72) Inventor: Matthew Fischer, Stanwood, WA (US)

( * ) Notice: Subject to any disclaimer, the term of this patent is extended or adjusted under 35 U.S.C. 154(b) by 8 days.

(21) Appl. No.: 18/418,222

(22) Filed: Jan. 20, 2024

Related U.S. Application Data

(60) Provisional application No. 63/440,349, filed on Jan. 20, 2023.

(51) Int. Cl.
*A47G 29/14* (2006.01)
*A47G 29/28* (2006.01)
*A47G 29/30* (2006.01)

(52) U.S. Cl.
CPC ..... *A47G 29/141* (2013.01); *A47G 29/28* (2013.01); *A47G 29/30* (2013.01); *A47G 2029/143* (2013.01); *A47G 2029/145* (2013.01); *A47G 2029/149* (2013.01)

(58) Field of Classification Search
CPC ..... A47G 29/141; A47G 29/28; A47G 29/30; A47G 29/20; A47G 29/22; A47G 2029/143; A47G 2029/145; A47G 2029/149; E06B 7/32; E05G 7/00
See application file for complete search history.

(56) References Cited

U.S. PATENT DOCUMENTS 1,066,297 A * 7/1913 Meckert ..... A47G 29/22 232/14
4,422,441 A 12/1983 Schoepe
4,776,300 A 10/1988 Braddock
5,505,358 A 4/1996 Haase
9,873,549 B2 1/2018 Heinz
10,076,204 B1 9/2018 Sadeghi
10,299,617 B1 * 5/2019 Castellanos ..... A47G 29/141
10,383,471 B1 8/2019 Barnes
10,537,196 B1 1/2020 MacPherson
10,653,261 B2 5/2020 Loures
10,696,453 B2 6/2020 Sena
(Continued)

FOREIGN PATENT DOCUMENTS

JP 05016993 A 1/1993
KR 20160107894 A 9/2016
(Continued)

*Primary Examiner* — William L Miller
(74) *Attorney, Agent, or Firm* — Bold IP, PLLC; Houda El-Jarrah

(57) ABSTRACT

The package holder incorporates a front cover having several rungs assembled in a cascading, accordion style that when the front cover is in its expanded position to cover the interior cavity of the package holder, the several rungs are fully expanded and when the front cover is in its collapsed position, the several rungs fit together. The package holder includes a frame structure having one or more back surfaces and a bottom surface. The back surface is mountable using fasteners to a physical surface of a property. The package holder incorporates electronic and computer based locking mechanisms as well as non-electronic locking mechanisms. The package holder incorporates tracking sensing systems to track a package from a third-party delivery service that can automatically access the interior cavity of the package holder. A user can access the package from an interior of a property through an opening of the package holder.

16 Claims, 13 Drawing Sheets

(56) References Cited

U.S. PATENT DOCUMENTS

| | | | | |
|---|---|---|---|---|
| 10,743,693 | B2 * | 8/2020 | Newcomb | G06Q 10/0833 |
| 10,772,451 | B2 * | 9/2020 | Vernal Silva | A47G 29/20 |
| 10,786,103 | B2 | 9/2020 | Teoh | |
| 11,278,144 | B2 * | 3/2022 | Vernal Silva | A47G 29/141 |
| 11,896,151 | B2 * | 2/2024 | Myrick | A47G 29/30 |
| 12,016,478 | B2 * | 6/2024 | Newcomb | A47G 29/141 |
| 12,178,343 | B2 * | 12/2024 | McCutcheon | A47G 29/141 |
| 2003/0006275 | A1 * | 1/2003 | Gray | A47G 29/14 232/19 |
| 2005/0224567 | A1 * | 10/2005 | Stagnaro | A47G 29/12 232/35 |
| 2017/0127868 | A1 | 5/2017 | Adewuyi | |
| 2018/0228310 | A1 * | 8/2018 | Enobakhare | A47G 29/20 |
| 2019/0362577 | A1 * | 11/2019 | Vigil | G07C 9/27 |
| 2020/0013008 | A1 * | 1/2020 | Newcomb | A47G 29/14 |
| 2020/0071991 | A1 | 3/2020 | Rupesh | |
| 2020/0107663 | A1 | 4/2020 | Elvaz | |
| 2021/0045564 | A1 * | 2/2021 | Duckers | E06B 3/483 |
| 2021/0127880 | A1 | 5/2021 | Raphael et al. | |
| 2022/0312999 | A1 * | 10/2022 | Myrick | A47G 29/30 |

FOREIGN PATENT DOCUMENTS

| | | | |
|---|---|---|---|
| WO | 02087923 | A1 | 11/2002 |
| WO | 182595 | A1 | 11/2016 |
| WO | 257938 | A1 | 12/2020 |
| WO | 061044 | A1 | 3/2022 |

* cited by examiner

PACKAGE PROTECTION DEVICE

CROSS-REFERENCE TO RELATED APPLICATION

This application is a non-provisional application which claims priority to U.S. Provisional Patent Application No. 63/440,349 filed on Jan. 20, 2023, which is incorporated by reference in its entirety.

FIELD OF THE DISCLOSURE

The present invention relates to a new system and apparatus for a package protection device to store delivered packages and prevent theft.

BACKGROUND

There are many different types of packages that can be delivered in today's environment via one or more third party delivery services, such as AMAZON or via any of the retailers that sell items that can be delivered to one's home, business, or another type of property. Unfortunately, the rate of thefts of such delivered items and packages is an ongoing problem with very few options for preventing such thefts. Homes and/or businesses or other locations do not usually include package protection devices that can be securely and easily locked and unlocked to store delivered packages by both the homeowner and the delivery service. Further, there is a need for a package holder at a location that can be mounted to one or more surfaces on an interior and exterior of a building or residence that can be accessible to the owner and the delivery person in a secure manner.

SUMMARY

The present description includes one or more non-limiting embodiments for a package holder comprising a frame structure having a back surface, a left side surface, a right side surface, and a front cover. The front cover may further comprise a base platform, a front cover left side, a front cover right side, and a front cover front side that are positioned over the base platform. One or more rungs are connected together in a cascading, accordion style arrangement, wherein the front cover raises and lowers to reveal an interior cavity as defined by the base platform, the front cover left side, the front cover right side, and the front cover front side of the front cover, wherein the one or more rungs as assembled raise and lower independently of the base platform but wherein the one or more rungs are still mounted and attached to the base platform at one or more connection points on the base platform. The package holder may further comprise at least one locking mechanism, wherein when the one or more rungs fully cover the interior cavity of the package holder, the front cover is secured in place until the at least one locking mechanism is unlocked in order to raise or lower the front cover of the frame structure in order to expose the interior cavity of the package holder.

In a non-limiting embodiment, the base platform may be perpendicular to the front cover left side and front cover right side of the front cover of the package holder. Further, the one or more rungs of the front cover are configured to fit together in a collapsed position over each other between the left side and the right side of the front cover and behind or above the front side of the front cover when the one or more rungs are in the collapsed position.

Further, the one or more rungs of the front cover are configured to fit together in a collapsed position when the front cover is in an open position and to expand when the front cover is in a closed position. The package holder further is mountable to a floor or ground surface using one or more fasteners insertable into fastener holes positioned on the package holder. The at least one locking mechanism comprises a non-electronic locking mechanism. The non-electronic locking mechanism comprises a holder or a lock for receiving a physical key or includes a key code pad configured to receive a secure code.

Further, in a non-limiting embodiment, the at least one locking mechanism comprises an electronic locking mechanism triggered by a key fob, a key car, or an access code.

The present description may further include a method for electronically delivering and securing a package in a package holder, the method comprising providing a package holder. The package holder may further include one or more fasteners to fastenably mount the package holder to an exterior surface of a physical structure and a tracking sensing system integrated into the package holder. In a non-limiting embodiment, the method may further include mounting and securely attaching the package holder to an exterior surface of a physical structure of a property using the one or more fasteners to fastenably mount the package holder. The method may further include receiving a signal intercepted by the tracking sensing system integrated into the package holder from an attached tracking tag attached to a package, wherein the package is located on a delivery vehicle of a third-party delivery service provider when the delivery vehicle of the third-party delivery service provider is within an operational range from the package holder. The method may further include, upon the package and the attached tracking tag being within the operational range from the package holder, automatically unlocking the front cover of the package holder and automatically opening the front cover of the package holder. The method may further include receiving the package inside of the package holder, wherein a delivery person of the third-party delivery service deposits the package inside of the package holder after the front cover is automatically unlocked and automatically opened. The method may further include locking of the at least one locking mechanism and closing of the front cover to secure the package inside of the package holder. In a non-limiting embodiment, the at least one locking mechanism is an electronic locking mechanism and/or a computer operated locking mechanism. Further, in a non-limiting embodiment, the front cover may be automatically raised or lowered or manually raised or lowered and then locked over a deposited package. Further, the separate non-electronic locking mechanism is integrated into the package holder in addition to the electronic locking mechanism and/or the computer operated locking mechanism and the separate non-electronic mechanism is lockable upon receiving the package inside of the package holder. In a non-limiting embodiment, the non-electronic locking mechanism is a lock having an associated key or a key pad. In a non-limiting embodiment, the package holder further comprises a biometric scanner to receive a biometric identifier from the delivery person or another party in order to unlock the package holder or to lock the package holder. In a non-limiting embodiment, the method may further include automatically locking the front cover of the package holder after a set period of time in which the front cover is unlocked and open. The method may further include creating an opening in a wall surface behind a back surface of the package holder, wherein the opening in the wall surface provides exposure from an interior of a property into the interior cavity of the package holder from the interior of the property to access the package even when the package holder is mounted to the exterior surface of the physical structure of the property. In a non-limiting embodiment, the user is able to access the package from the interior of the property through the opening in the wall surface of the package holder.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

The present description is drawn to one or more exemplary embodiments for a package holder that can be used to safely and securely house delivered packages and items to a property. The package holder can be useful for preventing theft because the package holder includes one or more locking mechanisms and systems to prevent theft of the delivered packages once the delivered packages are enclosed within the package holder. Further details are provided below with respect to the Figures.

Figure 1A:
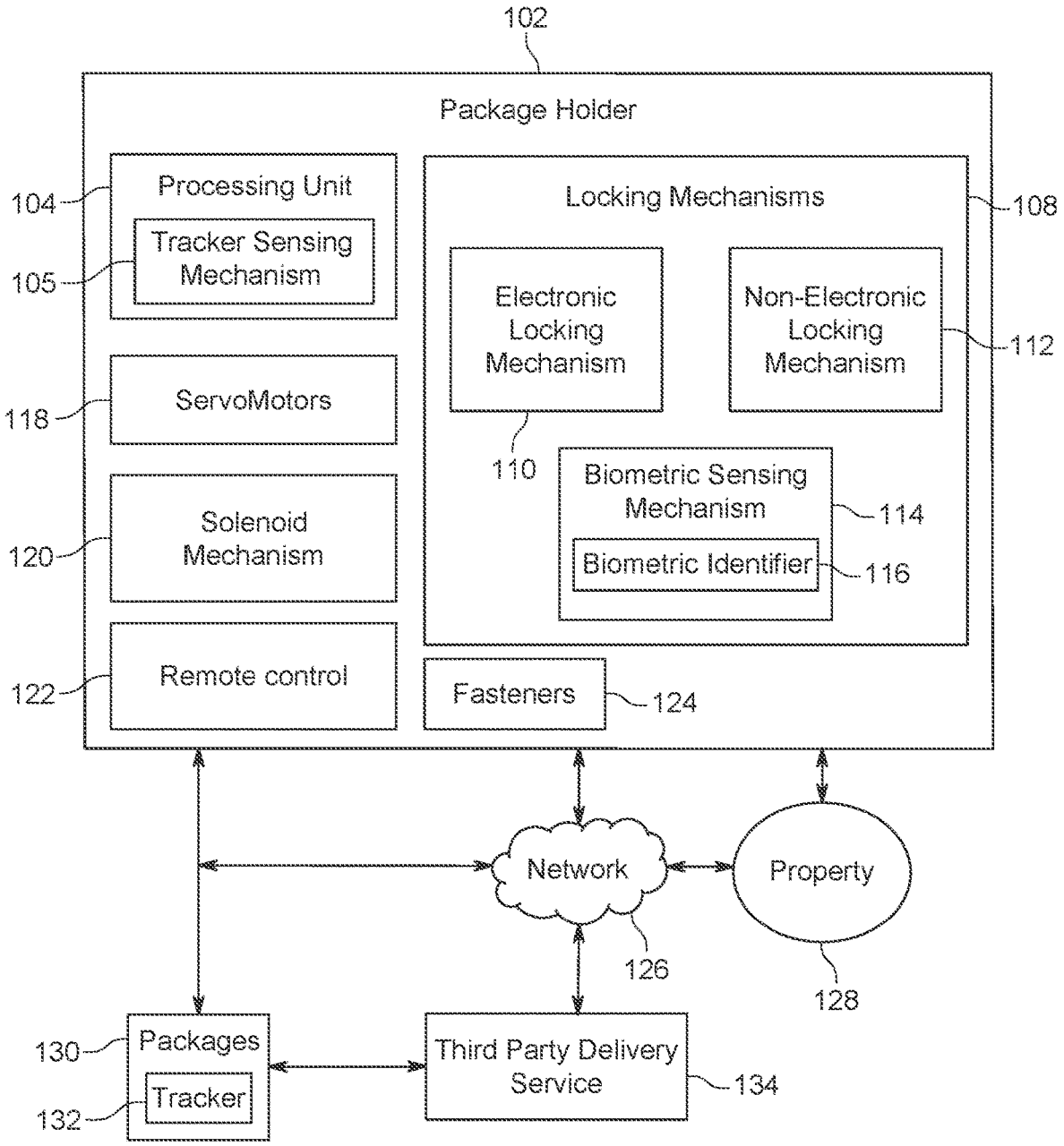
FIG. 1A depicts a block diagram with exemplary components of a system utilizing a package holder.

FIG. 1A is a block diagram with exemplary components of a system 100 for a package holder 102 as described herein according to one or more non-limiting embodiments. The package holder 102 is configured to be a secure package holder that can be accessed by a third-party delivery service 134 or any other party that delivers a package 130. The package holder 102 is further illustrated in one or more non-limiting embodiments in FIGS. 2-12 and may generally be designed to have a frame structure that encloses a package inside of the frame structure of the package holder 102.

In a non-limiting embodiment, the package holder 102 may include one or more locking mechanisms 108 that enable the package holder 102 to be an anti-theft device to prevent any theft of any delivered packages 130 from a third-party delivery service 134 to the property 128. The package holder 102 is a package holding device or apparatus that acts as a secure enclosure that can be locked and unlocked by various parties to securely deposit a package that can be held in safekeeping within the package holding device 102 after a third-party delivery service 134 has securely deposited the package 130 within the interior of the package holder 102. A third-party delivery service 134 may be any entity that delivers packages 130 to a user or owner or other authorized representative of the package holder 102. The third-party delivery service 134 may be any delivery company, including but not limited to AMAZON, UBER EATS, DOORDASH, FAVOR, or any other type of delivery company. The delivery companies or entities may also include mail carrier companies or organizations including, but not limited to, THE UNITED STATES POSTAL SERVICE, FED EX, UPS, DHL, or any other type of mail carrier companies or organizations. It is noted that any entity or person may use the package holder 102 to deliver and/or store packages 130 inside of the package holder 102 or other items that need safekeeping, whether or not the delivery entity is a company or not. Further, the property 128 may be any type of property, whether residential or commercial or any other type of property.

The delivered packages 130 may include food or non-food items. The delivered packages 130 may be provided by the third-party delivery service 134 once a user has ordered the products/items to be delivered as packages 130 via any type of website or other ordering means.

Normally, packages when delivered by third-party delivery services 134 or another entity or person are left outside of a user's property 128 in a manner that is exposed and does not include a means to prevent the theft of such delivered packages 130. For example, third-party delivery services 134 usually deliver and leave the unprotected delivered packages in front of a front door, back door, and/or garage of a user or property owner. However, this does not protect the packages 130 from theft or from being possibly ruined from rain, snow, or other adverse weather elements.

The package holder 102 is meant to protect and house the delivered packages 130 until the user or another party retrieves the delivered packages 130 from the inside of the package holder 102. Notably, the package holder 102 may have one or more locking mechanisms 108 to lock and secure the package holder 102 with the delivered one or more packages 130 located inside of the package holder 102.

Figure 1B:
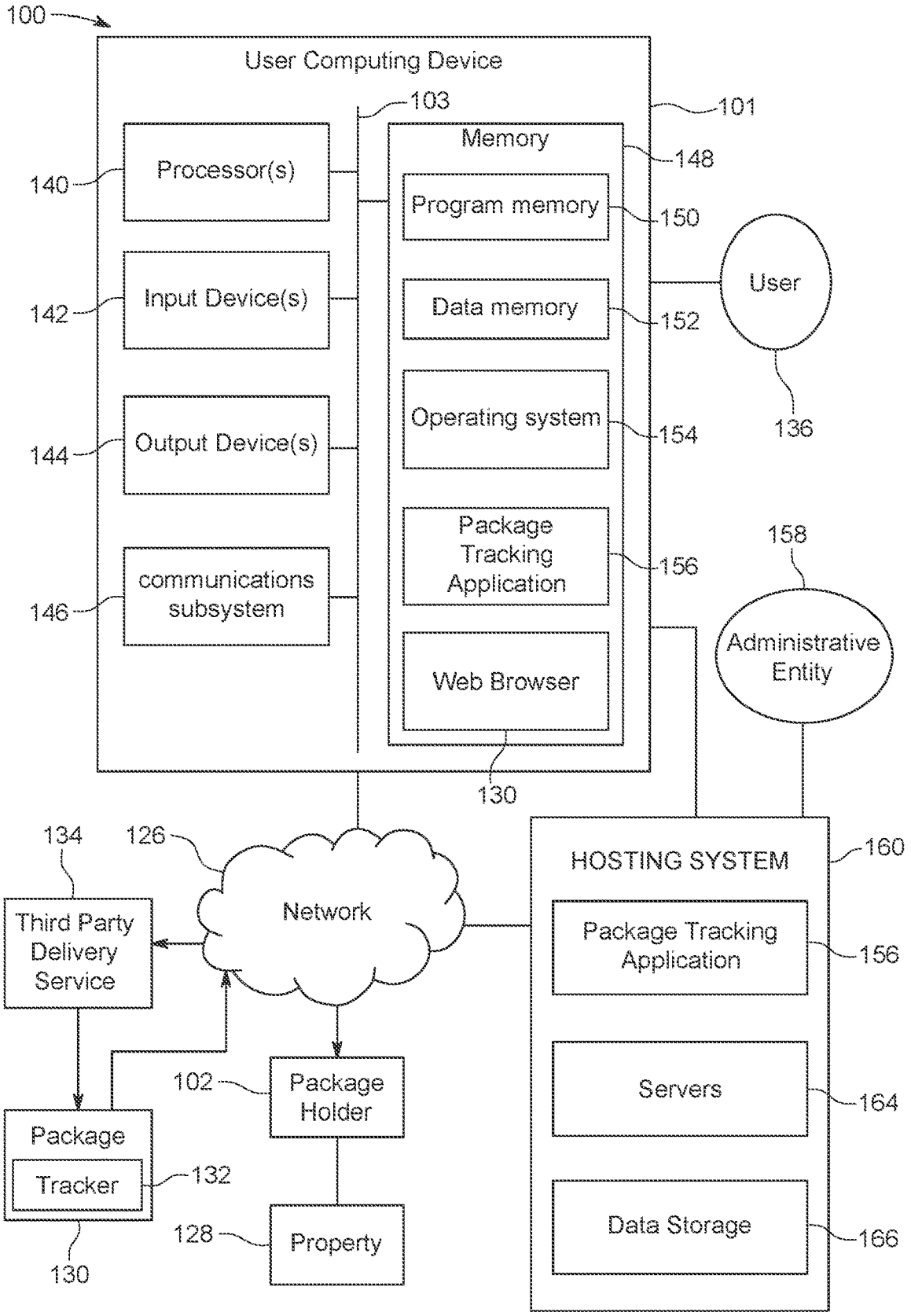
FIG. 1B depicts a block diagram with exemplary components of a system utilizing a package holder along with a computer implemented method and application.
Figure 2:
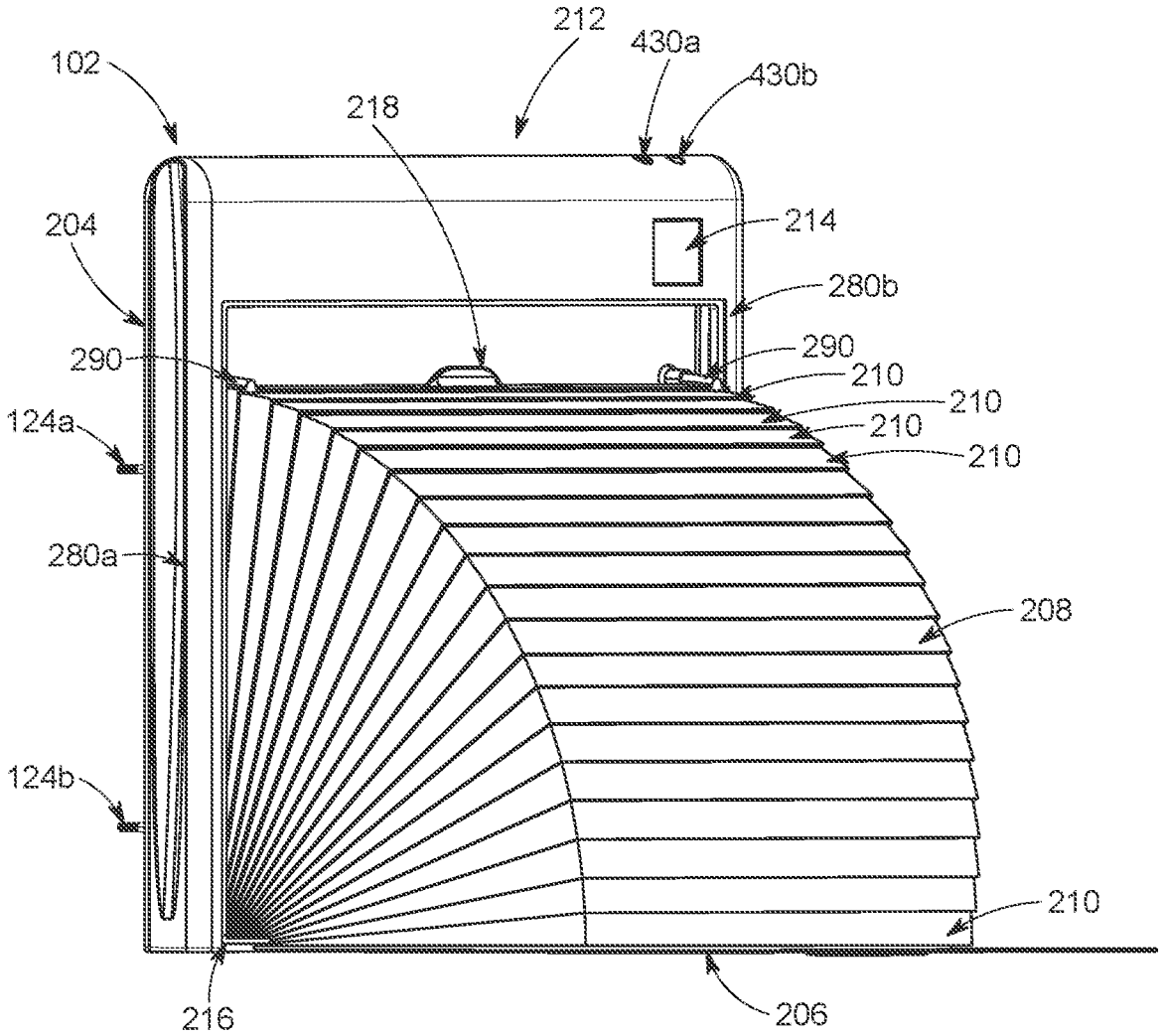
FIG. 2 depicts a pictorial illustration of a first embodiment of a package holder from a front perspective view with the front cover in a raised position.

In a non-limiting embodiment, there may be "smart" electronic locking mechanisms 110 that can be remotely actuated by a device including a computing device to lock or unlock a cover, such as a front cover 208, as shown in a non-limiting embodiment in FIG. 2, of the package holder 102. The computing devices that may be used may be a user's phone or smartwatch or tablet or any other kind of computing device 101 (e.g., as shown in FIG. 1B) and may utilize one or more computer applications (e.g., package tracking application 156) to coordinate the process of locking or unlocking the package holder 102, including but not limited to the computing device 101 shown in FIG. 1B. The computing device 101 may be associated also with a third-party delivery service 134 and include professional scanning tools and/or computing devices.

A user or owner of the package holder 102 may use the user's computing device and a computer application to lock and unlock the package holder 102 upon demand. Further, employees and staff of the third-party delivery service 134 may be enabled to lock or unlock the package holder 102 using the smart and/or electronic locking mechanism 110 in one or more non-limiting embodiments. The smart and/or electronic locking mechanism 110 may include a digital, electronic, or computer related system for providing one or more barcodes and/or other types of codes to lock and/or unlock the smart and/or electronic locking mechanism 110. Such smart and/or electronic locking mechanisms 110 may be unlocked via an electronic fob device or an electronic card configured to receive electronic and/or digital keys. In another application, the smart and/or electronic locking mechanisms 110 may be unlocked via approval by a computer implemented application, such as package tracking application 156 further described in FIG. 1B.

In a non-limiting embodiment, an electronic code may be generated and sent to authorized individuals to use to lock or unlock the package holder 102 if there is a smart and/or electronic locking mechanism 110 integrated into the structure of the package holder 102. In such instances, there may be a processing unit 104 integrated with the package holder 102 configured to send and receive instructions over a network 126. The network 126 may be a WIFI enabled network, cellular based network, ETHERNET based network, BLUETOOTH, or any other type of network usable to send and receive data and implement instructions via one or more processing units 104 and/or computing devices. In particular, the package holder 102 with its processing unit 104 may be configured to receive instructions to lock and unlock the package holder 102 via a separate computing device 101. The user/owner of the package holder 102 may be notified when a package 130 is delivered and located within a package holder 102 on the property 128. Further, the third-party delivery service 134 may also have a record and notification of the delivery of the package 130 and its safe storage within the package holder 102 in order to provide tracking. There may be additional components needed to operate the one or more smart and/or electronic locking mechanisms 110, including but not limited to, input devices, output devices, power sources, memory, and other elements that have been omitted for purposes of simplification at this time.

In a non-limiting embodiment, the electronic locking mechanism may include a number of visible buttons and selectors (e.g., 430) that the user and/or other individual may select in order to lock and/or unlock the front cover 208 or another element of the package holder 102. FIGS. 2-10 include examples of such selectors (e.g., 430*a*, 430*b*) that may be used to symbolically represent the lock and unlock selectors of the electronic locking mechanism 110 that may be integrated with the package holder 102 in one or more non-limiting embodiment.

In a non-limiting embodiment, the deliverable packages 130 may include a tracker 132 that can be sensed and tracked by the tracker sensing mechanism 105 integrated into the package holder 102. The tracker 132 may be attached and/or physically and/or electronically embedded and integrated into the outer or the inner make up or structure of the package 130. The tracker 132 may be sensed by the tracking sensing mechanism 105. In particular, when the tracker 132 is programmed to be in signal communication with the tracking sensing mechanism 105, the tracker 132 may act as a key to unlock the front cover 208 and/or one or more other sides or components of the package holder 102 so as to access the interior of the package holder 102 for purposes of depositing the package 130 in a safe and secure location on the property 128. The tracker sensing mechanism 105 may or may not be included with the processing unit 104 of the package holder 102 as shown in FIG. 1A. In a non-limiting embodiment, the tracker sensing mechanism 105 may be a radio-frequency identification (RFID) reader/tracker. The RFID tracker 105, in such an exemplary embodiment, may be part of the Internet of Things (IoT) tracking technology usable to connect a physical asset such as the package 130 to a data collection tool such as the tracker sensing mechanism 105. In such an instance, the tracker 132 on the deliverable package 130 may include an RFID tag 132 that can be detected by the tracker sensing mechanism 105 when the package 130 as tagged with the RFID tracker 132 or other type of tracker 132 is within operational range of the package holder 102 and the tracker sensing mechanism 105 that is integrated and operational within the package holder 102 on the property 128. In this manner, the user and/or property owner may be provided with real time feedback status about the delivery status of the package 130. Also, the package holder 102 may be configured to automatically unlock or to be prompted to unlock when the package 130 having the RFID tracker 132 is brought within an operational range or distance to cause the package holder 102 to open and/or unlock.

In a non-limiting embodiment, the tracker 132 may be an active, passive, or semi-passive RFID tag. It may be preferable, that the tracker 132 may operate under at least a high frequency or an ultra-high frequency in order to allow for the best tracking conditions for the package holder 102 of the deliverable packages 130 from a distance. It is generally understood that high frequency RFID trackers (e.g., tracker 132) have a range of up to 1 meter for detection by a tracking mechanism such as the tracker sensing mechanism 105. For ultra-high frequency RFID trackers (e.g., tracker 132), the read-range is usually at least up to 150 meters and such ultra-high frequency RFID trackers may provider faster data transfer speeds. The high frequency RFID tags (e.g., tracker 132) may operate at a frequency of approximately 13.65 Mhz and the ultra-high frequency RFID tags (e.g., tracker 132) may operate at a frequency of approximately 433 and 860-960 Mhz. It is understood that these numerical values are solely exemplary and may be variable in application.

The package holder 102 may include other possible non-electronic locking mechanisms 112 that may be utilized in addition to or separate from smart and/or electronic locking mechanism 110. In a non-limiting embodiment, such non-electronic locking mechanisms 112 may include any type of lock that includes any type of key mechanism. In a non-limiting embodiment, the key mechanism may be a physical type of key. In other non-limiting embodiments, the non-electronic locking mechanism may refer to any type of locking mechanism that does not include a computing device or computer application (e.g. such as but not limited to a computing device 101 and package tracking application 156). The non-electronic locking mechanisms may thus include locking systems that include padlocks, key codes, and/or physical key structures. The non-electronic locking mechanisms 112 may be built-into and integrated into the package holder 102 including in a manner that the front cover 208 (e.g., as shown in FIG. 2) is enabled to be unlocked when the key of the non-electronic locking mechanism 112 is inserted and/or provided (e.g., entered) into the non-electronic locking mechanism 112 of the package holder 102. In a non-limiting embodiment, an example of a non-electronic locking mechanism 112 may include a ratchet lock in particular connected to the one or more rungs 210 to cause the rungs 210 to automatically lock when raised or lowered in a particular direction. The ratchet lock may be built into the package holder 102.

In a non-limiting embodiment, in addition to or as an alternative to the electronic locking mechanisms 110 and the non-electronic locking mechanisms 112, the package holder 102 may include a biometric sensing mechanism 114 that requires a biometric identifier 116. The biometric sensing mechanism 114 may employ a variety of technologies and methods including, but not limited to, phone numbers, fingerprints, face recognition, or other biometric technologies. The biometric sensing mechanism 114 may verify and authenticate one or more parties authorized to unlock the package holder 102 via a number of biometric identifiers that may relate to a user's face, finger, sound, iris, or any other biometric identifiers. The biometric identifiers 116 may be stored in association with authorized representatives of a third-party delivery service 134 and/or the authorized users and/or owners of the property 128 to ensure that the package holder 102 may only be unlocked by authorized, verified individuals.

Figure 4:
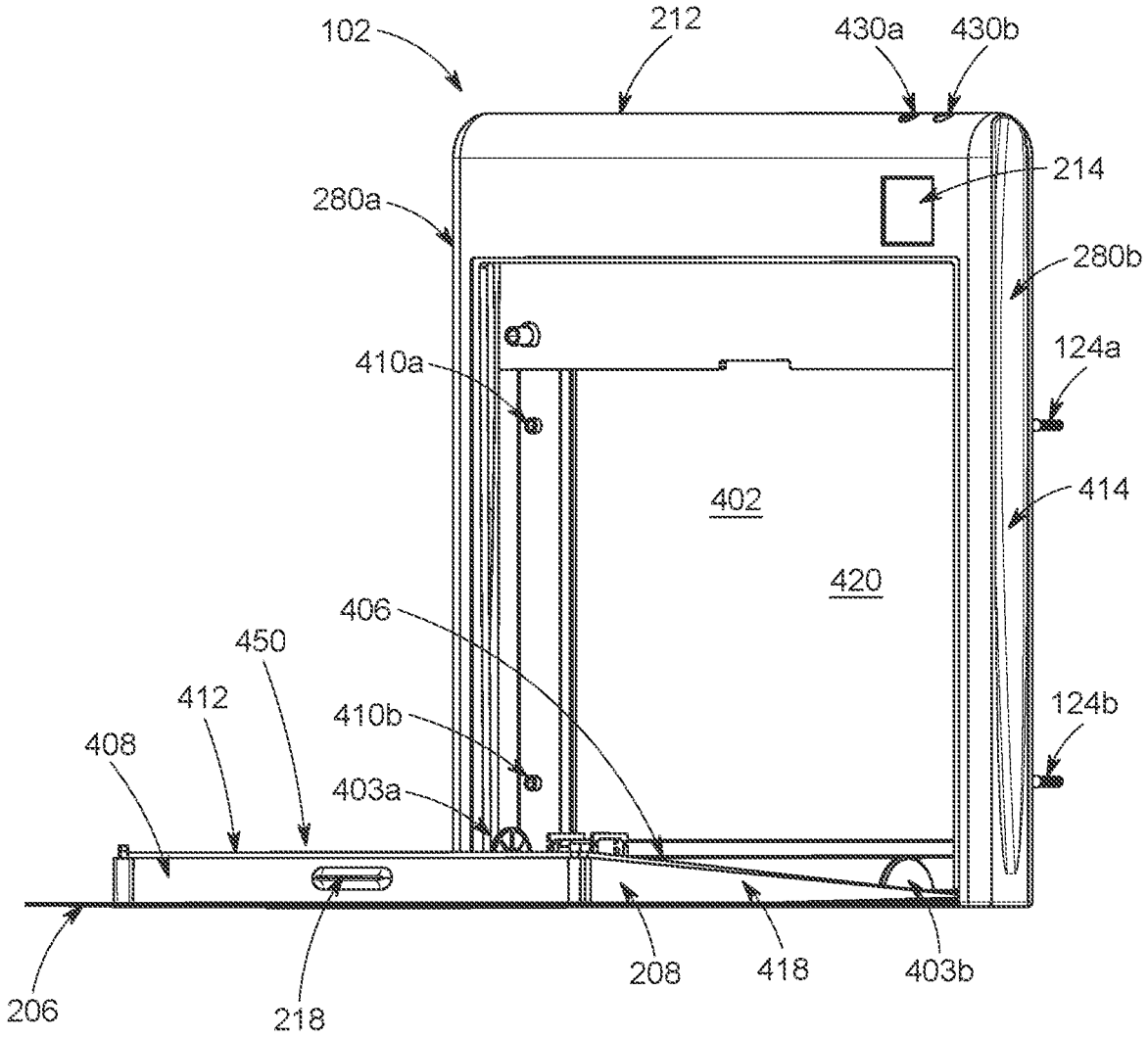
FIG. 4 depicts a pictorial illustration of the package holder of FIG. 2 shown with the front cover in a lowered position.

Further, the package holder 102 may be associated or paired with one or more remote controls 122 that can open the front cover 208 (e.g., as shown in FIG. 2) and/or back cover 402 (e.g., as shown in FIG. 4 and in FIG. 11) of the package holder 102 as required. The remote control 122 may be in addition to at least one locking mechanism 108, which may include either a smart, digital, and/or electronic locking mechanism 110 or a non-electronic locking mechanism 112 or a biometric sensing mechanism 114.

It is noted that the locking mechanisms 108 may include one or more solenoid mechanisms 120 to operate the locking mechanisms 108 to control the locking mechanisms 108 remotely.

In a non-limiting embodiment, the package holder 102 may include one or more servomotors 118 as shown in FIG. 1A. The servomotors 118 may be positioned on either side of the package holder 102 for one on each lateral side (or other location on the package holder 102). The servomotors 118 may function to open and close the package holder 102. In other embodiments, one or more gears may alternatively or additionally be used to the servomotors 118.

FIG. 1A illustrates that one or more fasteners 124 may be provided for integrated fastener holes built into the package holder 102 in order to insert the one or more fasteners 124 so as to be able to mount and securely attach the package holder 102 to a wall and/or floor surface of the property 128. It may be desirable to mount the package holder 102 anywhere as desired on the property 128, including but not limited to, an area of the property 128 that may be accessed from a front side or rear side of the property 128 or another lateral side of the property 128. The package holder 102 may be mounted and/or attached to a wall on a garage of a property 128 or to a front wall of the property 128 in other non-limiting embodiments. An accompanying hook may be provided to also hook in addition fasten the package holder 102 to a surface on the property 128. Accordingly, it is intended that the package holder 102 can be mountable and attachable to a physical surface on the property 128 from either one or more sides or surfaces of the package holder 102 in order to ensure that the package holder 102 is not easily removable from the property 102. It is noted that the package holder 102 may be provided in a variety of sizes to accommodate small to larger packages 130 that are intended to be delivered to the package holder 102.

Turning to FIG. 1B, FIG. 1B illustrates an exemplary system 100 for one or more computing devices 101 and the various exemplary components that may be employed in practicing one or more non-limiting embodiments of the invention as described herein. Computing device 101 may be any type of computing device known or to be created in the future. This may include, without limitation, fixed in place computers, such as desktop computers, or mobile computing devices. Mobile computing devices may include, but are not limited to, laptop computers, smartphones, mobile phones, tablets, wearable electronic computing devices such as watches or glasses, or any other type of mobile electronic, computing device.

FIG. 1B provides a schematic illustration of one embodiment of a computing device 101 that can perform the methods provided by the various other listed embodiments, as described herein, and/or can function as the host computer system, a remote kiosk/terminal, a point-of-sale device, a mobile device, a set-top box and/or a computer system. FIG. 1B is meant only to provide a generalized illustration of various components, any or all of which may be utilized as appropriate. FIG. 1B, therefore, broadly illustrates how individual system elements may be implemented in a relatively separated or relatively more integrated manner.

Computing device 101 may be any type of information handling system, including, but not limited to, any type of computing device as noted above. To reiterate, this may include small handheld devices, such as handheld computer/mobile telephones or may include large mainframe systems, such as a mainframe computer. Further examples of handheld computing devices may include personal digital assistants (PDAs), personal entertainment devices, such as MP3 players, portable televisions, and compact disc players. Other examples of computing devices 101 may include, but are not limited to, laptops, notebooks, workstation computers, personal computer systems, as well as servers (e.g., servers 164). Computing devices 101 can be used by various parties described herein and may be connected on a computer network, such as computer network 126. Types of computer networks that can be used to interconnect the various information handling systems may include, but are not limited to, Local Area Networks (LANs), Wireless Local Area Networks (WLANs), the Internet (e.g., World Wide Web), the Public Switched Telephone Network (PSTN), other wireless networks, and any other network topology that can be used to interconnect the information handling systems.

The computing device 101 is shown comprising hardware elements that can be electrically coupled via a bus 103 (or may otherwise be in communication, as appropriate). The hardware elements of computing device 101 may include one or more processors 140, including without limitation one or more general-purpose processors and/or one or more special-purpose processors (such as digital signal processing chips, graphics acceleration processors, and/or the like). Computing device 101 may further include one or more input devices 142, which can include without limitation one or more cameras, sensors (including inertial sensors), a mouse, a keyboard and/or the like, which may be utilized in the implementation of package tracking application 156.

In addition to the above, computing device 101 may include one or more output devices 144 such as the device display. Furthermore, in some embodiments, an input device 142 and an output device 144 of computing device 101 may be integrated, for example, in a touch screen or capacitive display as commonly found on mobile computing devices as well as desktop computers and laptops.

Processors 140 may have access to a memory such as memory 148. Memory 148 may include one or more of various hardware devices for volatile and non-volatile storage and may include both read-only and writable memory. For example, memory 148 may comprise random access memory (RAM), CPU registers, read-only memory (ROM), and writable non-volatile memory, such as flash memory, hard drives, floppy disks, CDs, DVDs, magnetic storage devices, tape drives, device buffers, and so forth. A memory 148 is not a propagating signal divorced from underlying hardware; a memory is thus non-transitory. Memory 148 may include program memory such as program memory 150 capable of storing programs and software, such as an operating system such as operating system 154, package tracking application 156, and other computerized programs or application programs. Memory 148 may also include data memory such as data memory 152 that may include database query results, configuration data, settings, user options or preferences, etc., which may be provided to program memory 150 or any element of computing device 101.

The computing device 101 may further include (and/or be in communication with) one or more non-transitory storage devices, which can comprise, without limitation, local and/or network accessible storage, and/or can include, without limitation, a disk drive, a drive array, an optical storage device, a solid-state storage device such as a random access memory ("RAM") and/or a read-only memory ("ROM"), which can be programmable, flash-updateable and/or the like. Such storage devices may be configured to implement any appropriate data storage, including without limitation, various file systems, database structures, and/or the like. Device storage may be used in a number of embodiments discussed herein. Further, the storage devices may be non-volatile data storage devices in one or more non-limiting embodiments. Further, computing device 101 may be able to access removable nonvolatile storage devices that can be shared among two or more information handling systems (e.g., computing devices) using various techniques, such as connecting the removable nonvolatile storage device to a USB port or other connector of the information handling systems.

The computing device 101 might also include a communications subsystem 146, which can include without limitation a modem, a network card (wireless or wired), an infrared communication device, a wireless communication device and/or chipset (such as a Bluetooth™ device, an 802.11 device, a WiFi device, a WiMax device, cellular communication facilities, etc.), and/or the like. The communications subsystem 146 may permit data to be exchanged with a network (e.g., such as network 126), other computer systems, and/or any other devices.

The computing device 101 or system 100 also can comprise software elements, shown as being currently located within the memory 148, which in some instances may include an operating system 154, device drivers, executable libraries, and/or other code, which may comprise computer programs provided by various embodiments, and/or may be designed to implement methods, and/or configure systems, provided by other embodiments, as described herein. Merely by way of example, one or more procedures described with respect to the method(s) discussed above might be implemented as code and/or instructions executable by a computer (and/or a processor within a computer). In an aspect, then, such code and/or instructions can be used to configure and/or adapt computing device 101 to perform one or more operations in accordance with the described methods.

A set of these instructions and/or code might be stored on a computer-readable storage medium, such as the storage device(s) described above. In some cases, the storage medium might be incorporated within a computer system, such as computing device 101. In other embodiments, the storage medium might be separate from computing device 101 (e.g., a removable medium, such as a compact disc or USB stick), and/or be provided in an installation package, such that the storage medium can be used to program, configure, and/or adapt a general-purpose computer with the instructions/code stored thereon. These instructions might take the form of executable code, which is executable by the computing device 101 and/or might take the form of source and/or installable code, which, upon compilation and/or installation on the computing device 101 (e.g., using any of a variety of generally available compilers, installation programs, compression/decompression utilities, etc.) then takes the form of executable code.

Substantial variations may be made in accordance with specific requirements. For example, customized hardware might also be used, and/or particular elements might be implemented in hardware, software (including portable software, such as applets, etc.), or both. Further, connection to other computing devices such as network input/output devices may be employed.

Some embodiments may employ a computer system (such as the computing system 100) to perform methods in accordance with the disclosure. For example, some or all of the procedures of the described methods may be performed by the computing device 101 in response to one or more processors 140 executing one or more sequences of one or more instructions (which might be incorporated into the operating system 154 and/or other code contained in the memory 148). Such instructions may be read into the memory 148 from another computer-readable medium, such as one or more of the storage devices. Merely by way of example, execution of the sequences of instructions contained in the memory 148 may cause the one or more processors 140 to perform one or more procedures of the methods described herein.

The terms "machine-readable medium" and "computer-readable medium," as used herein, refer to any medium that participates in providing data that causes a machine to operate in a specific fashion. In an embodiment implemented using the computing device 101, various computer-readable media might be involved in providing instructions/code to the one or more processors 140 for execution and/or might be used to store and/or carry such instructions/code (e.g., as signals). In many implementations, a computer-readable medium is a physical and/or tangible storage medium. Such a medium may take many forms, including but not limited to, non-volatile media, volatile media, and transmission media. Non-volatile media may include, for example, optical and/or magnetic disks which may be an example of storage devices. Volatile media may include, without limitation, dynamic memory, which may be a type of memory included in memory 148. Transmission media may include, without limitation, coaxial cables, copper wire and fiber optics, including the wires that comprise the bus 103, as well as the various components of the communications subsystem 146 (and/or the media by which the communications subsystem 146 provides communication with other devices). Transmission media can also take the form of waves (including without limitation radio, acoustic, and/or light waves, such as those generated during radio-wave and infrared data communications).

Common forms of physical and/or tangible computer-readable media include, for example, a floppy disk, a flexible disk, hard disk, magnetic tape, or any other magnetic medium, a CD-ROM, any other optical medium, any other physical medium with patterns of holes, a RAM, a PROM, EPROM, a FLASH-EPROM, any other memory chip or cartridge, a carrier wave as described hereinafter, or any other medium from which a computer can read instructions and/or code.

Various forms of computer-readable media may be involved in carrying one or more sequences of one or more instructions to the processor(s) 140 for execution. Merely by way of example, the instructions may initially be carried on a magnetic disk and/or optical disc of a remote computer. A remote computer might load the instructions into its dynamic memory and send the instructions as signals over a transmission medium to be received and/or executed by the computer system 100. These signals, which might be in the form of electromagnetic signals, acoustic signals, optical signals and/or the like, are all examples of carrier waves on which instructions can be encoded, in accordance with various embodiments of the invention.

The communications subsystem 146 (and/or components thereof) generally will receive the signals, and the bus 103 then might carry the signals (and/or the data, instructions, etc. carried by the signals) to the memory 148, from which the one or more processors 140 retrieves and executes the instructions. The instructions received by the memory 148 may optionally be stored on a non-transitory storage device either before or after execution by the processor(s) 140.

In one or more embodiments, computing device 101 is in communication with one or more networks, such as network 126. Network 126 may include a local area network (LAN), such as a company Intranet, a metropolitan area network (MAN), or a wide area network (WAN), such as the Internet or World Wide Web. Network 126 may be a private network, a public network, or a combination thereof. Network 126 may be any type of network known in the art, including a telecommunications network, a wireless network (including Wi-Fi), and a wireline network. Network 126 may include mobile telephone networks utilizing any protocol or protocols used to communicate among mobile digital computing devices (e.g., computing device 101), such as GSM, GPRS, UMTS, AMPS, TDMA, or CDMA. In one or more non-limiting embodiments, different types of data may be transmitted via network 126 via different protocols. In further non-limiting other embodiments, computing device 101 may act as a standalone device or may operate as a peer machine in a peer-to-peer (or distributed) network environment.

Network 126 may further include a system of terminals, gateways, and routers. Network 126 may employ one or more cellular access technologies including but not limited to: 2nd (2G), 3rd (3G), 4th (4G), 5th (5G), LTE, Global System for Mobil communication (GSM), General Packet Radio Services (GPRS), Enhanced Data GSM Environment (EDGE), and other access technologies that may provide for broader coverage between computing devices if, for instance, they are in a remote location not accessible by other networks.

In one or more non-limiting embodiments, a computing device, such as computing device 101 may include a web browser such as web browser 130. Web browser 130 may be any type of web browser known in the art that may be used to access one or more web applications (e.g., package tracking application 156) on user computing devices 101 or the like. Web applications are applications that are accessible by network 126 and may be located on the Internet or World Wide Web. Web browser 130 may include a variety of hardware, software, and/or firmware generally operative to present a web application to a user via a display device 144 (e.g., touchscreen or other type of monitor or display device) on a computing device. Examples of suitable web browsers include, but are not limited to, MICROSOFT EXPLORER, MOZILLA FIREFOX, and APPLE SAFARI. Web browser 130 may be previously installed by the manufacturer or company associated with the computing device 101, or alternatively, may be downloaded onto computing device 101 or any other computing device. Web browser 130 may be stored in a separate storage device and/or memory 148.

In one or more non-limiting embodiment, package tracking application 156 may be a software program or module configured to allow a user 136 to complete one or more certification processes remotely and electronically. Accordingly, package tracking application 156 allows a user 101 to track, authorize, remotely unlock and cause a front cover 208 of a package holder 102 to open (as further explained below and shown in an example in FIGS. 8-9), and/or remotely lock the front cover 208 of the package holder 102. The package tracking application 156 may be used to electronically and via one or more signals transmitted through the package tracking application 156 to the processing unit 104 of the package holder 102 to unlock and lock the front cover 208 and/or access another access point of the package holder 102.

In one or more non-limiting embodiments, package tracking application 156 may be implemented as a downloadable program or application storable on user computing device 101 for easy accessibility and viewability. Package tracking application 156 may alternatively be implemented as a web service that is designed to implement a set of tasks that is accessible from multiple computing devices, such as computing device 101 over a network, such as network 126. In particular, package tracking application 156 may be implemented as a web service accessible using the World Wide Web as the connecting network 126, although any alternative type of network may be used, including cellular networks. Accordingly, user 101 may download package tracking application 156 on user 136's computing device 101 and use the input devices 142 of the computing device 101 to enter data pertinent to the package tracking application 156. The display screen, which is one of the output devices 144 of the user computing device 101, may display any pertinent forms, images, instructions, and fields viewable in the package tracking application 156, as further explained below.

A user 136 may invoke a series of web service calls via requests to one or more servers 164 that are part of the hosting system 160 which would host package tracking application 156. In one or more non-limiting embodiments, hosting system 160 may be a cloud-based type hosting system. "Cloud-based" is a term that refers to applications, services, or resources (e.g., package tracking application 156) made available to users on demand via a network, such as network 126, from a cloud computing provider's server. Administrative entity 158 may be the cloud computing provider and may use servers 164 to provide access to data storage 166 and other systems that work in conjunction with the operation and maintenance of package tracking application 156.

Hosting system 160 may include data storage systems 166 that can provide access to stored data by applications running on computing devices, such as computing device 101, that may be geographically separate from each other, provide offsite data backup and restore functionality, provide data storage to a computing device with limited storage capabilities, and/or provide storage functionality not implemented on computing device 101.

The hosting system 160 may be a service that can be implemented as a web service, in one or more non-limiting embodiments, with a corresponding set of Web Service Application Programming Interfaces (APIs). The Web Service APIs may be implemented, for example, as a Representational State Transfer (REST)-based Hypertext Transfer Protocol (HTTP) interface or a Simple Object Access Protocol (SOAP)-based interface. Any programming languages may be used to create or operate package tracking application 156 as a web service, including, but not limited to .Net, Java, and XML. Further, package tracking application 156 as a web service may use standardized industry protocol for the communication and may include well-defined protocols, such as Service Transport, XML Messaging, Service Description, and Service Discovery layers in the web services protocol stack.

The hosting system 160 can be implemented such that client applications (for example, executing on computing device 101) can store, retrieve, or otherwise manipulate data objects in the hosting system 160. The hosting system 160 can be implemented by one or more server devices 164, which can be implemented using any type of computing device.

In one or more non-limiting embodiments, administrative entity 158 is the provider and creator of package tracking application 156. Administrative entity 158 may make package tracking application 156 available to any client or user, such as user 136, who wants to use the features of package tracking application 156. Administrative entity 158 may be able to manipulate and alter code and/or instructions for package tracking application 156 remotely so as to affect the operation and maintenance of package tracking application 156 on server(s) 164 and as stored on one or more data storage devices 166 that are part of the hosting system 160. While administrative entity 158 is depicted as a single element communicating over network 126 and through the hosting system 160, it is noted that administrative entity 158, in one or more non-limiting embodiments, may be distributed over network 126 in any number of physical locations.

In one or more non-limiting embodiments, package tracking application 156 may be a downloadable software module that is capable of being downloaded and stored directly on a computing device, such as computing device 101, and/or accessible from the cloud or other system via network 126. Accordingly, any user may be able to download package tracking application 156 on computing device 101 as a computer-based application and software module that runs using the working engines and modules on the computing device 101. In some embodiments, package tracking application 156 may be preinstalled on computing device 101 or any other computing device by the manufacturer, designer, or other entity. Package tracking application 156 may be innate, built into, or otherwise integrated into existing platforms such as, without limitation thereto, a website, third-party program, iOS™, Android™, Snapchat™, Getty Images™, Instagram™, Facebook™, or any other platform capable of transmitting, receiving, and presenting data.

Package tracking application 156 may be stored on computing device 101 and may also be stored or otherwise accessible by one or more servers 164 over network 126 by any party. The storage devices may include a non-transitory computer readable medium including instructions, which when executed by a computer or processor (such as processors 140) may cause the computer or processor to perform operations to implement package tracking application 156. Further information about other components of package tracking application 156 are included below with respect to the Figures.

A third-party delivery service 134 may be responsible for delivering package 130 to the package holder 102 mounted or otherwise located or attached to one or more surfaces of the property 128. The package 130 may be tracked via a tracker 132 whereby the tracker 132 is embedded in a packaging of the package 130 and/or otherwise attached to the packaging of the package 130. In other non-limiting embodiments, the tracker 132 may be attached to another package or item located inside of the packaging or container for the package 132. The package tracking application 156 may be configured in operation with the tracker 132 to automatically or when prompted or upon request, unlock a front cover 208 or another surface of the package holder 102 in order for a delivery person from the third-party delivery service 134 to deliver the package 130 into the inside area of the package holder 102. In a non-limiting embodiment, the package tracking application 156 may serve as an app or an application on a user's computing device 101. The user may include the delivery person or other authorized party representing the third-party delivery service 134. The package tracking application 156 may communicate electronically and in signal communication over the network 126 with the tracker 132 located on or in the package 130 in order to affect the lock or unlock status of a locking mechanism 108 of the package holder 102, including but not limited to, the electronic locking mechanism 110 and/or a biometric sensing mechanism 114 of the package holder 102.

FIG. 2 illustrates an exemplary, non-limiting embodiment for a package holder 102. The package holder 102 shown in FIG. 1 may comprise, in one or more non-limiting embodiments, a frame structure that includes a back surface 204, a left side surface 280*a*, a right side surface 280*b*, a front cover 208 that includes a base platform 206 that acts as a bottom surface in some cases for the package holder 102. The back surface 204 and the base platform 206 may be hingedly connected at one or more opposite lower ends 216, in one or more non-limiting embodiments by one or more hinge mechanisms and hinge points (i.e. 216). The front cover 208 and the remaining components of the frame structure of the package holder 102 may define an interior cavity 412, as shown in FIG. 4, dedicated to holding any delivered packages 130 delivered by a third-party delivery service, such as the third-party delivery service 134 shown in FIG. 1A and in FIG. 1B and described above. As noted above, the package holder 102 may further include one or more locking mechanisms 108 including electronic locking mechanisms 110 and non-electronic locking mechanisms 112 that are incorporated into one or more parts of the package holder 102.

Figure 5:
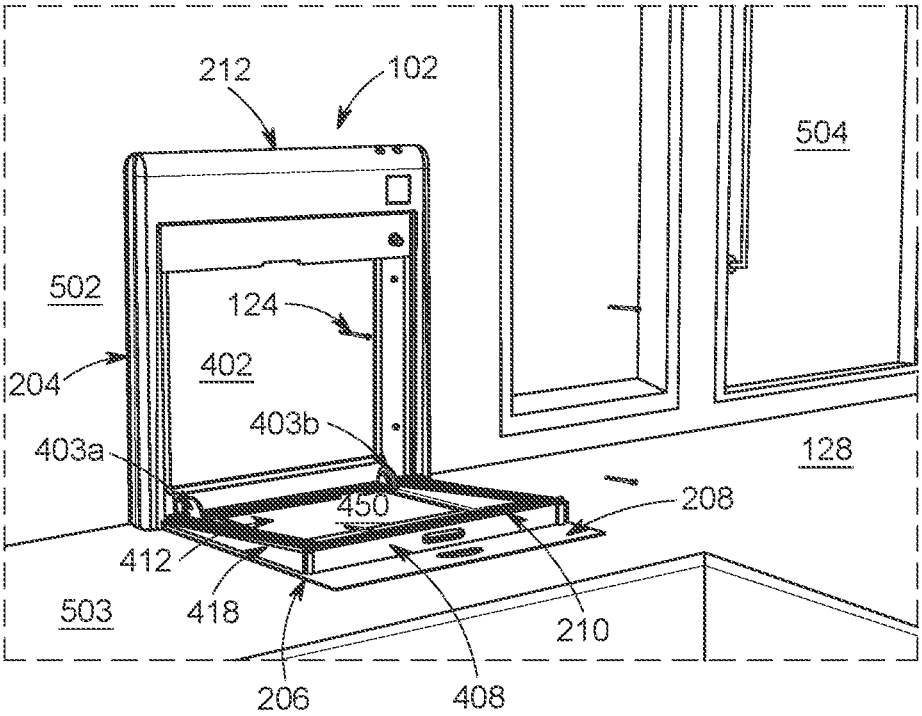
FIG. 5 depicts a pictorial illustration of a package holder mounted or attached to a property for use in receiving delivered packages by a third-party delivery service.

As shown in FIG. 2, there may be a front cover 208 that integrates two main covering surfaces which include the base platform or bottom surface 206 and also the one or more assembled rungs 210 which can raise and lower separately or independently from the raising or lowering of the base platform 206 as a whole. The front cover 208 may include several rungs 210 as shown in FIG. 2 according to one or more non-limiting embodiments. While there are about 20 rungs 210 shown in FIG. 2, in other embodiments, there may be a greater or lesser number of rungs 210 other than as shown in this example. In a non-limiting embodiment, as shown in FIG. 5 and in FIG. 6, the bottom surface 206 of the package holder 102 serves as a front cover when the rungs 210 are collapsed and the base platform 206 of the front cover 208 is raised up and locked or otherwise closed while the package holder 102 is mounted or otherwise secured to a surface (e.g., 502) of a property 128. In other non-limiting embodiments, the base platform 206 can be lowered and remain flat but the delivered package 130 inside of the package holder 102 is covered by the raised front cover 208 which comprises the plurality of rungs 210 in order to still offer protection and coverage of the delivered package 130.

Figure 3:
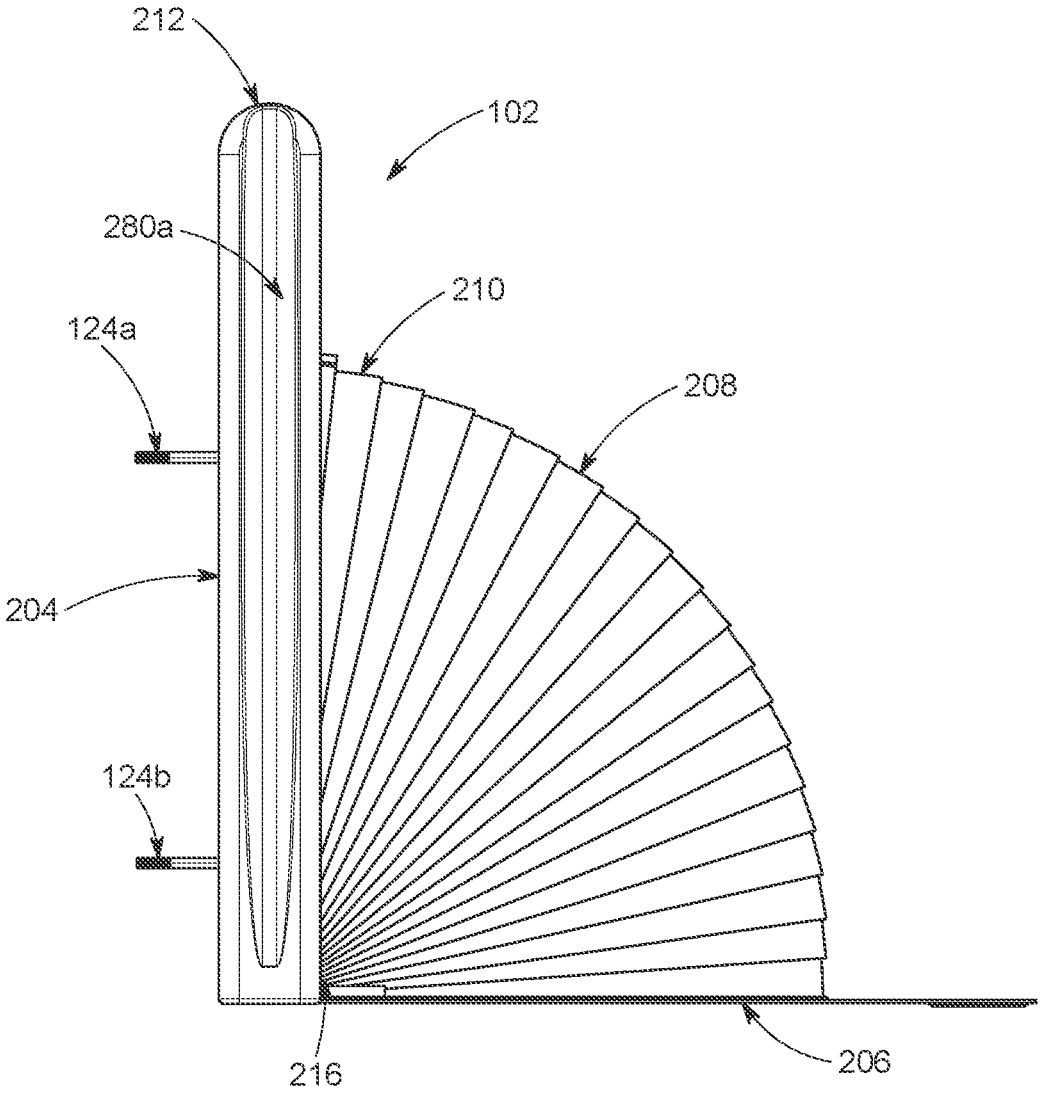
FIG. 3 depicts a pictorial illustration of the package holder of FIG. 2 shown from a left side view which may mirror the right side view.
Figure 10:
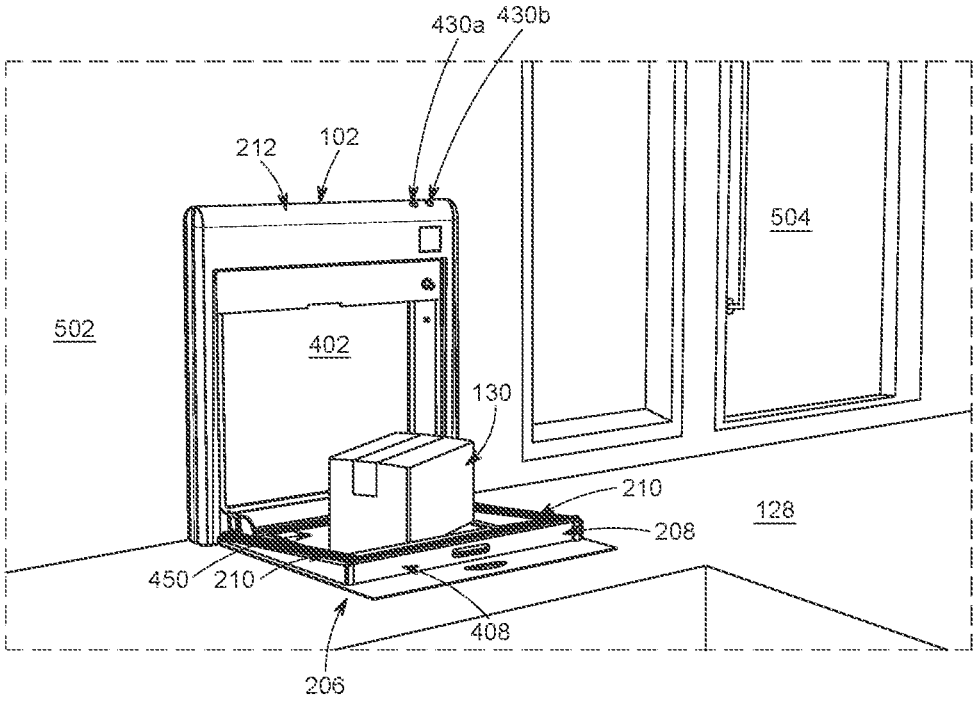
FIG. 10 depicts a pictorial illustration of a tracked package deposited into the interior cavity of the package holder.

The accordion style rungs 210 may be integrated into the front cover 208 in a cascading, pleated, accordion style arrangement such that the uppermost rung 210, intermediate rungs 210, and the lowermost rung 210 can each collapse into each prior rung 210 until the front cover 208 is in the open position and all rungs 210 are collapsed together. In a non-limiting embodiment, when the front cover 208 is fully raised, the rungs 210 are each fully expanded and not in a collapsed, reduced position. FIG. 2 and FIG. 3 show such an example of a fully raised, expanded appearance of the front cover 208 in which the front cover is in its closed and/or locked position. As shown in FIG. 2 and in FIG. 3, each rung 210 is connected on two hinge points 216 located on each lower end of the package holder 102. Further, each rung 210 is fully expanded in FIG. 2 and in FIG. 3. FIG. 4 shows the example in which the rungs 210 have been fully collapsed together and are held within the confines of the front cover 208. FIG. 10 also shows how the rungs 210 are collapsed against each other in a collapsed manner in which each previous rung 210 fits together in between the left and right raised side surfaces 418 (e.g., as shown in FIG. 4 and in FIG. 10) of the front cover 208. Accordingly, FIG. 4 shows that the front cover 208 is a self-contained unit in which the rungs 210 can be fully raised or lowered from an expanded to a collapsed position and vice versa. As noted above, the rungs 210 are assembled in a cascading, pleated, accordion style that are hinged at common hinge points (e.g., 216). The front cover 208 in the form of the assembled rungs 210 is contained between the raised side surfaces 418 on each left and right side and also behind the raised front surface 408, as shown in FIG. 4. In a non-limiting embodiment, there may be a pull handle 218 that can be used to pull up or down the front cover 208 comprising the assembled, connected, cascading rungs 210. In a non-limiting embodiment, one or more stoppers 290, as shown in FIG. 2, may be integrated towards an upper portion of the package holder 102 to help keep the rungs 210 in place when fully raised.

One or more gears 403*a*, 403*b*, as shown in an exemplary embodiment, in FIG. 4, may be positioned at a base of each side of the front cover 208 near the hinge points 216 in order to facilitate the raising and lowering of the front cover 208. When the rungs 210 are fully raised and positioned against a top surface 212 of the package holder 102 such that each rung 210 is fully splayed out and not in a collapsed, stored position, the interior cavity 412 of the package holder 102 is not visible. When the front cover 208 is fully open and in its fully lowered position, each rung 210 is fully collapsed and contained telescopically within the sides 418 of the front cover 208 structure and behind the front surface 408 of the front cover 208. The package holder 102 may include an interior facing package receiving bottom surface 450 (e.g., as shown in FIG. 4, FIG. 5, and in FIG. 11) that is perpendicular to the back (exterior facing 420) surface 402 of the package holder 102 and to the front cover 208. The package receiving bottom surface 450 may be located between the left and right raised side surfaces 418 of the front cover 208 in a non-limiting embodiment. The bottom surface 450 of the package holder 102 is the surface intended or configured to receive the deposited, delivered package 130 as delivered by the authorized representative of the third-party delivery service 134. Accordingly, as shown for example, in FIG. 10, the deposited tracked package 130 is able to sit and rest on the bottom surface 450 behind the raisable and lowerable front cover 208 of the package holder 102.

Figure 6:
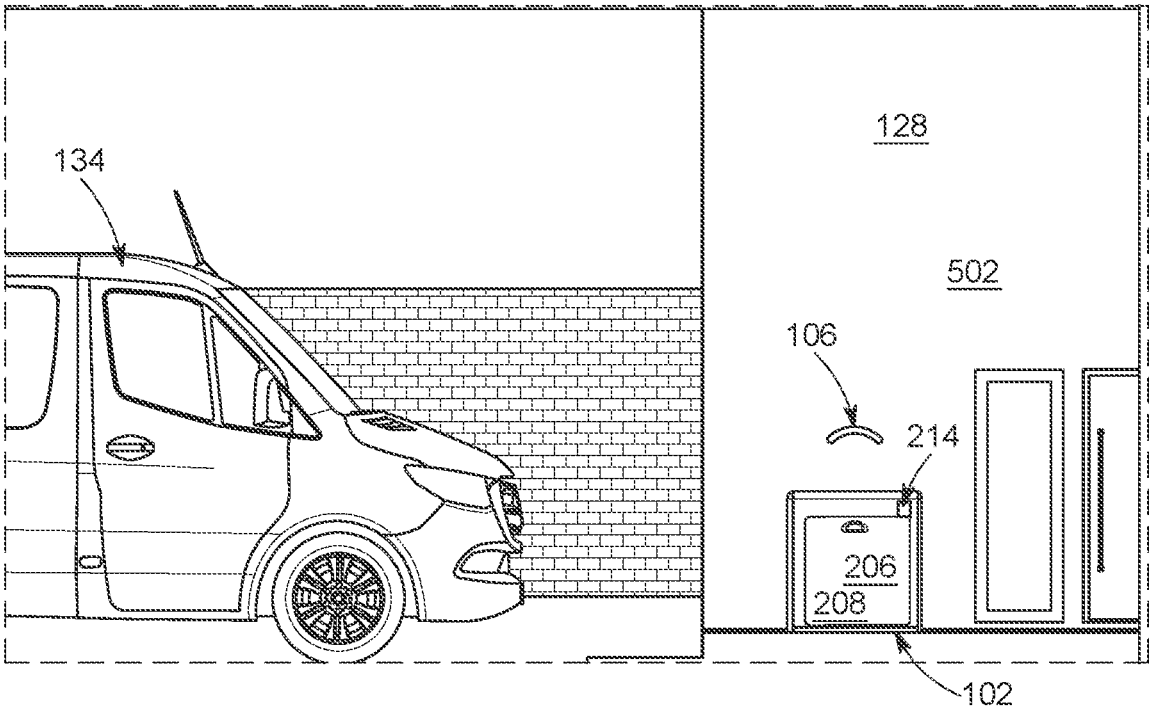
FIG. 6 depicts a pictorial illustration of a third-party delivery service vehicle having a tracked package approach a property with a package holder.

The frame of the package holder 102 may have upper vertical left and right side surfaces 280*a*, 280*b* on a left and right side of the frame of the package holder 102 having a pre-determined thickness 414 that provides sufficient depth to hold the front cover 208 when the rungs 210 are collapsed together (e.g., as shown in FIG. 6) and when the front cover 208 is raised and locked in place.

Figure 11:
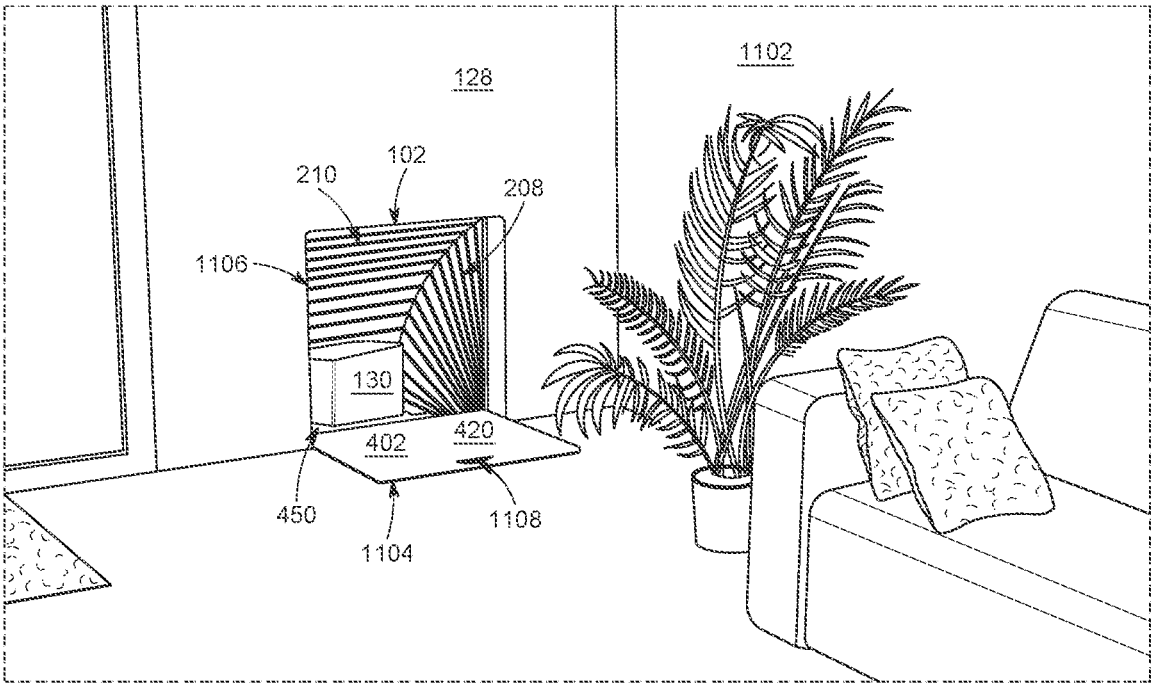
FIG. 11 depicts a pictorial illustration of an interior of a property with an opening of the package holder accessible from the inside of the property for a property owner to access a delivered package located within the package holder.

In a non-limiting embodiment, the back surface 402 of the package holder 102 is recessed. As shown in FIG. 4 and elsewhere in FIG. 11 and in FIG. 12, in a non-limiting embodiment, the back surface 402 of the package holder 102 may be configured to open into another room or location of the property 128 (e.g., as shown in FIG. 11 and in FIG. 12). Accordingly, FIG. 4 shows that the exterior or outward facing surface 420 of the back surface 402 is intended to be visible and accessible to an authorized representative of a third-party delivery service 134 and the front cover 208 is configured to raise and lower to provide access to the interior cavity 412 and to the package receiving bottom surface 450 of the package holder 102. Further, in one or more non-limiting embodiment, the interior facing side 1104, as shown for example in FIG. 11, of the back surface 402 may be pulled down via a handle 1108 into the property 128 to access the interior cavity 412 of the package holder 102 and access the delivered package 130.

In a non-limiting embodiment, the package holder 102 may be fastened to and attached or mounted to one or more surfaces of the property 128. FIG. 3 shows a first fastener 124*a* and a second fastener 124*b* as an example of a set of fasteners 124 that may be used to mount or attach via the fasteners 124 to the property 128. FIG. 4 shows an example of corresponding fastener holes 410*a*, 410*b*, that may be on an opposite side inside of the package holder 102 in order for the fasteners 124*a*, 124*b* and other exemplary fasteners to be mounted/attached to a surface of the property 128, which is further shown in FIG. 5.

As shown in FIG. 4, the frame of the package holder 102 may include an upper or top surface 212. On the top surface 212, there may be one or more exemplary selectors or buttons 430*a*, 430*b*. In a non-limiting embodiment, the selectors or buttons 430*a*, 430*b* may be associated with electronic locking mechanisms 110 and enable the user to select the buttons or selectors 430 to either lock or unlock the front cover 208 of the package holder 102. There may be a greater or lesser number of selectors 430 than those shown in FIG. 4 and in other Figures. A tracking identification locator 214 may be incorporated into or near the top surface 212 of the package holder 102 so as to readily identify and locate the tracking sensing mechanism 105 from an exterior of the package holder 102. Accordingly, in a non-limiting embodiment, an RFID tracking sensing mechanism 105 may be embedded or located generally where the tracking identification locator 214 is located on the package holder 102. Alternatively, a barcode reader may be embedded and/or integrated where the tracking identification locator 214 is located on the package holder 102.

In FIG. 5, it is shown that to install the package holder 102 onto the property 128, in a non-limiting embodiment, the package holder 102 may be fastenably and securely mounted to one or more wall surfaces 502 of the property 128 via one or more fasteners 124. In a non-limiting embodiment, it may be preferable to mount or attach the package holder 102 near a door 504 or other access point of the property 128. It is noted that the back surface 204 of the package holder 102 may be mounted to a wall surface 502 and other portions of other surfaces of the package holder 102 may be mounted to a floor surface 503 of the property 128. Notably, the package holder 102 may be mounted to floor and/or wall surfaces as needed. In other non-limiting embodiments, the package holder 102 may also be raised and hung over one or more doors via hooks and/or straps in other non-limiting embodiments and as such the package holder 102 may be raised off of a ground surface.

Once the package holder 102 is mounted, the front cover 208 is configured to be raised and closed via the one or more gears, wheels, or other hinge mechanisms 403*a*, 403*b* that raise and lower the front cover 208 from a collapsed to a fully expanded position.

In a non-limiting embodiment, as shown for example in FIG. 5, the rungs 210 of the package holder 102 are not expanded or raised initially. Rather, the rungs 210 may be collapsed together and the front cover 208 collapsed together (e.g. as shown in FIG. 4 and in FIG. 10). The rungs 210 may be expandable and lockable in place once the package 130 has been securely deposited on the interior bottom surface 450 of the package holder 102. In this manner, the package holder 102 is suitable for having a reduced foot print and not taking up an excess amount of space in any location where the package holder 102 is mounted on the property 128 because the rungs 210 are not fully pulled up to cover the package 130 unless the package 130 is deposited in the package holder 102's interior cavity 412 and either a manual or automatic locking of the expanded rungs 210 and the front cover 208 occurs using either a non-electronic locking mechanism 112 or an electronic locking mechanism 110.

FIGS. 6-12 show a series of illustrations for one or more embodiments and/or steps for engaging with and using a package holder 102 that features one or more unique aspects of the package holder 102.

In a non-limiting embodiment, as shown in FIG. 6, the base platform 206 of the front cover 208 of the package holder 102 is pushed upwards and locked in place. Further, the rungs 210 are fully collapsed and contained within the interior portion of the package holder 102. In this way, the package holder 102 has a smaller, collapsed footprint. The rungs 210 can be separately and independently raised and lowered from the bottom surface 206 of the package holder 102 or the back side of the front cover 208. In a non-limiting embodiment, there may be locking elements for the base platform 206 that operate independently of the locking elements or mechanisms for the rungs 210. In a non-limiting embodiment, a ratchet lock is included with the front cover 208 to automatically lock the rungs 210 in place when raised and a user may use a physical key to unlock the rungs 210 and access a delivered package 130.

As shown in FIG. 6, in a non-limiting embodiment, the package holder 102 is securely mounted to a surface 502 of the property 128. The front cover 208 may be locked using at least one locking mechanism 108 that locks the front cover 208. As noted above, this may include a non-electronic locking mechanism 112 that includes a physical key type apparatus and lock. Further, the package holder 102 may include one or more electronic locking mechanism 110 that is in signal communication with the package holder 102 separate from and/or in addition to the tracker sensing mechanism 105. There may also be a tracker sensor mechanism 105 that can be visibly located on the package holder 102 and may be represented by the tracker identification mechanism 214 shown in FIG. 6. In a non-limiting embodiment, the third party delivery service 134 may have one or more packages 130 to be delivered to property 128. In a non-limiting embodiment, a tracker 132 is embedded on the package 130 that is configured to operate in signal communication with the tracker sensor mechanism 105 as integrated into the tracker identification mechanism 214 shown in a non-limiting, exemplary embodiment in FIG. 6. Accordingly, as the delivery vehicle of the third-party delivery service 134 approaches and is in within operational range of the tracker sensing mechanism 105, a signal 106 is detected by the tracker sensing mechanism 105 of the package holder 102 and the front cover 208 of the package holder 102, which was initially not open, may be configured to open such that the front cover 208 is lowered as shown in FIG. 10 and the interior cavity 412 of the package holder 102 is accessible to the authorized delivery person or entity of the third-party delivery service 134 and such that the package 130 can be deposited onto the package receiving bottom surface 450 of the package holder 102.

Accordingly, in a non-limiting embodiment, the presence of a tracker 132 associated physically and/or electronically with the package 130 to be delivered causes the front cover 208 of the package holder 102 to open and unlock even if a property owner is not present. This is advantageous because the third-party delivery service 134 does not have to leave the package 130 at the property 128 unprotected and without a secure location to position the package 130 inside of. The tracker 132 in the package 130 may be configured to push notifications or provide notifications to the tracker sensing mechanism 105 which can be authorized by the processing unit 104 or another system to grant access or deny access so that the front cover 208 may be lowered or opened of the package holder 102. In a non-limiting embodiment, the front cover 208 of the package holder 102 can be automatically raised or closed again to automatically lock after a defined or set period of time.

Figure 7:
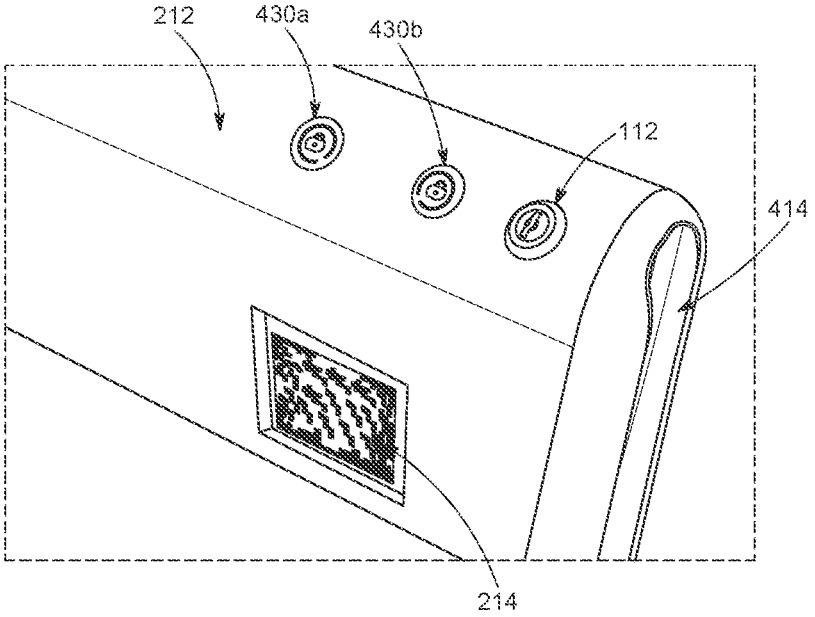
FIG. 7 depicts a pictorial illustration of an exemplary portion of a package holder depicting a tracking sensing mechanism, a non-electronic locking mechanism, and one or more exemplary locking mechanisms.
Figure 8:
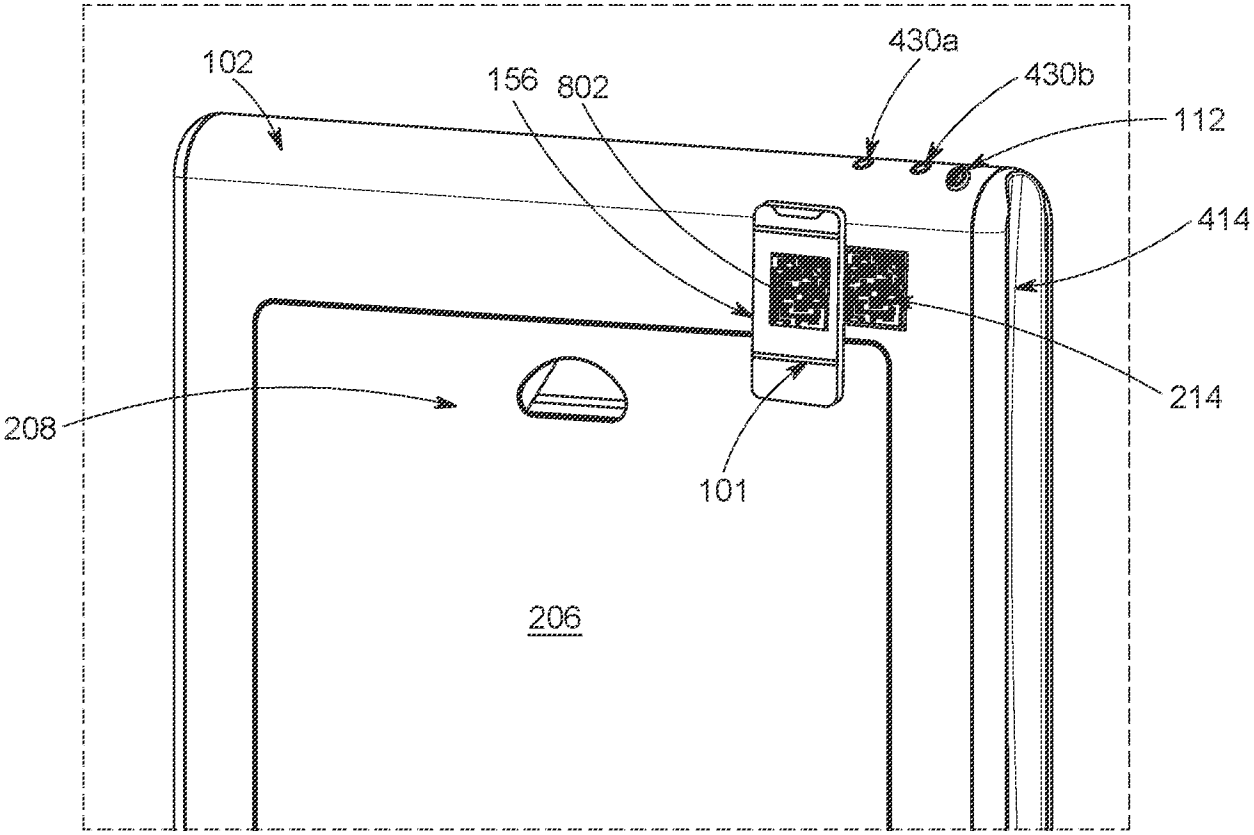
FIG. 8 depicts a pictorial illustration for a smart computing device with a package tracking application having an identifier corresponding to the tracking mechanism included with the package holder.
Figure 9:
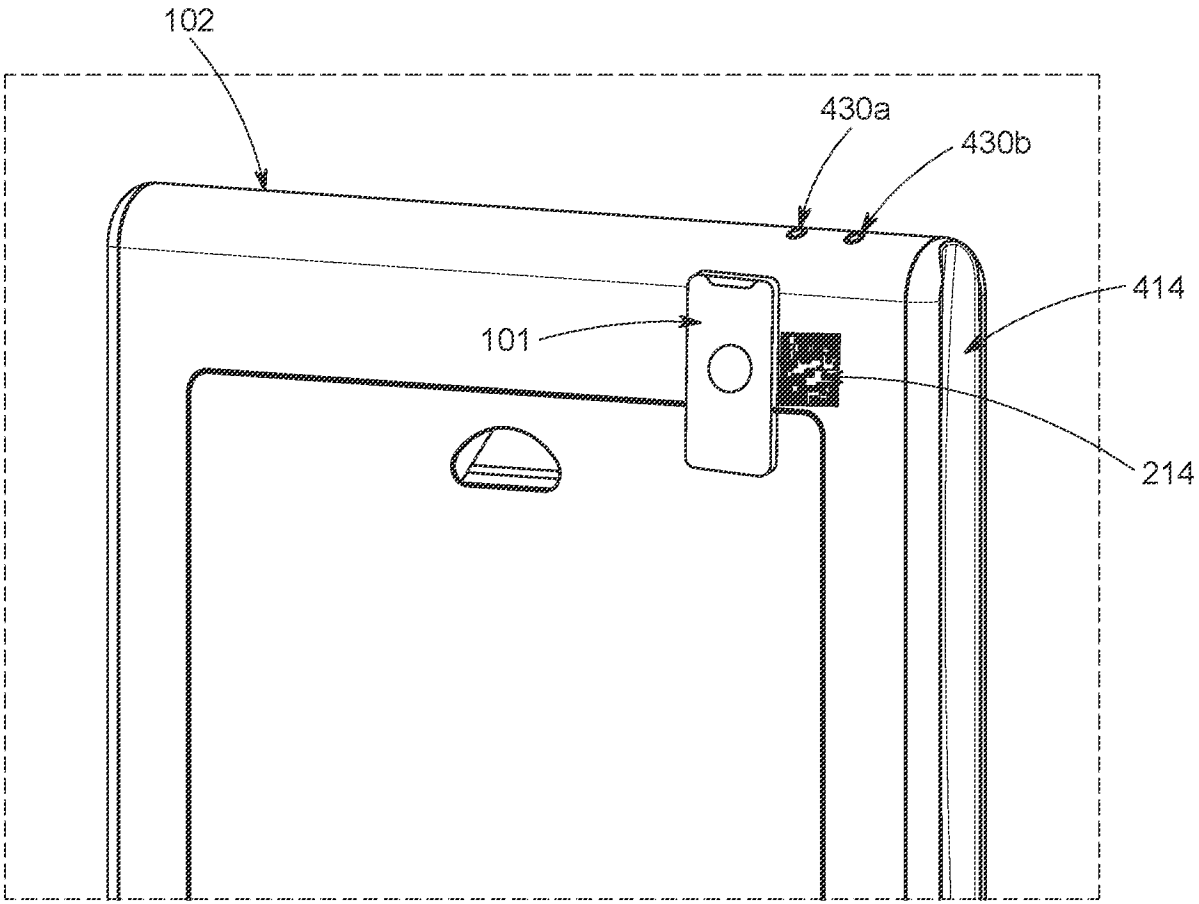
FIG. 9 depicts a pictorial illustration for a verification of the identifier on the package tracking application on the computing device that operates in conjunction with the tracking mechanism included with the package holder.

FIGS. 7-9 show some pictorial illustrations of exemplary steps in which a computing device 101 may also be utilized along with one or more locking mechanisms 108 if so desired to access the interior cavity 412 of the package holder 102 and to cause the front cover 208 to automatically open.

Notably, the front cover 208 includes one or more locking mechanisms 108 including a non-electronic locking mechanism 112 having a key holder as shown in FIG. 7 in a non-limiting embodiment. Further, there may be one or more selectors 430*a*, 430*b* to unlock and lock the front cover 208 electronically to via electronic locking mechanisms 110.

The tracker identification mechanism 214 may be configured to work with a package tracking application 156 as shown in FIG. 1B and described above and also shown in FIG. 8-9. There may be a corresponding identifier 802 that can be brought up or reflected on the package tracking application 156 on the user computing device 101 that can provide signal communication and authorization to the tracking identifier mechanism 214 in order to cause the front cover 208 to open automatically as long as the authorized identifier 802 is used and detected by the tracking identifying mechanism 214 from either the package tracking application 156 and/or the tracker 132 included in the package 130.

In this manner, there may be a number of methods in which the front cover 208 of the package holder 102 can be unlocked and locked. This may include using the package tracking application 156, one or more selectors 430 for electronic locking mechanisms 110 integrated with the package holder 102, and/or one or more physical keys that are insertable in a non-electronic locking mechanism 112 and/or key codes. These methods may be used independently or simultaneously to provide different types of users different means of accessing the package holder 102. For example, the property owner or other authorized representatives of the property may be provided with a physical key or key code to unlock the non-electronic locking mechanisms 112 included in the package holder 102 while deliverers from the third-party delivery service 134 may rely on the use of the downloaded package tracking application 156 on their computing devices 101 as well as the tracker 132 embedded in the package 130 and the tracking sensing mechanism 105 to provide automated, digital access to the package holder 102 such that the front cover 208 is configured to open upon request from the package tracking application 156 and/or tracking sensing mechanism 105 being triggered.

FIG. 10 illustrates that the front cover 208 has been lowered from its secured raised position as part of the mounted package holder 102 on the property 128. The delivery person of the third=party delivery service 134 is able to leave and deliver the package 130 directly inside of the interior cavity 412 of the package holder 102 and the entire bottom interior surface 450 of the package holder 102 is accessible for depositing the package 130 thereupon. In a non-limiting embodiment, the rungs 210 of the front cover 208 may then be manually raised up by the delivery person and caused to lock in place automatically when the rungs 210 reach the top. In other non-limiting embodiments, the rungs 210 may be locked using a key or electronic locking mechanisms 110, and/or biometric sensing mechanisms 114. Alternatively, or additionally, the use of the package tracking application 156 to trigger the expanding of the rungs 210 and the locking in place may also occur. Accordingly, the package holder 102 is able to securely hold and contain the delivered package 130 in a protected manner such that the package 130 is not exposed to outside elements, such as rain, or wind, or other outdoor elements and is also better secured against unwanted theft of the package 130.

Figure 12:
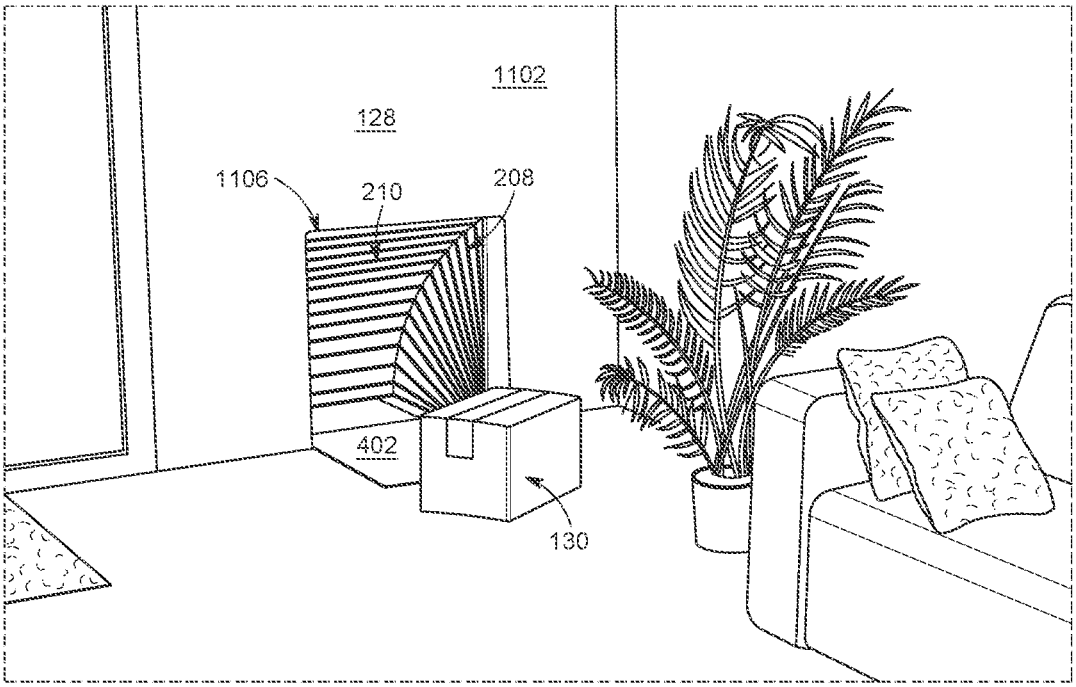
FIG. 12 depicts a pictorial illustration of the package brought into the inside of the property from the interior side of the package holder that opens onto an inside room or other location on the property.

FIGS. 11-12 illustrate another alternative non-limiting embodiment for the package holder 102. A shown in FIG. 11, the back surface 402 of the package holder 102 can be configured to open in reverse and reveal the interior contents including the delivered package 130 from an interior room or other type of location 1102 from inside of the property 128. Accordingly, the package holder 102 is not only mounted to an exterior wall surface 502 or other surface on an outside of the property 128, but also an opening 1106 is created behind the back surface 402 of the package holder 102 to allow for a user or other individual to access the packages 130 from inside of the interior cavity 412 of the package holder 102 without going outside and opening the front cover 208 from a front side of the package holder 102. The opening 1106 is created into a corresponding surface (e.g., wall surface 502 of the property 128) that will allow the back side 402 of the package holder 102 to be lowered through the opening 1106 as shown in FIG. 11 and in FIG. 12. Rather, the user may pull down or otherwise manipulate the interior facing side 1104 of the back surface 402 of the package holder 102 in order to access the package 130 from inside of the package holder 102 as deposited by an authorized delivery person of the third-party delivery service 134 on an outside of the package holder 102 (without being granted inside of the property 128). Only an authorized user associated with the property 128 may grant access to the delivered package 130 in the manner shown in FIG. 11 and in FIG. 12, in which the delivered package 130 can be slid out easily onto the back surface 402 and onto a floor surface or other surface of the property 128.

Accordingly, the package holder 102 and its assembled set of accordion style rungs 210 offer a number of unique features. It is noted that there may be multiple sizes for the package holder 102 that vary from very small to very large in size. In one non-limiting embodiment, the back surface 204 of the package holder 102 may be approximately eight inches tall and the bottom surface 206 may also be approximately eight inches long. Further, in other embodiments, the package holder 102 may be eighteen by eighteen inches or thirty-two inches by thirty-two inches in size. In other non-limiting embodiments, the package holder 102 may be significantly expanded in size and may even be designed to be large enough to cover a boat or car if needed. Accordingly, in such an embodiment, the package holder 102 may be mounted or attached to a wall or may be a standalone structure, and the vehicle or boat positioned within an interior cavity of the package holder 102, with an easily raised and lowered front cover 208 similar to the front cover 208 shown in FIG. 2 and in FIG. 3.

While not shown in the Figures, in one or more non-limiting embodiment, the package holder 102 may further include a ratchet locking mechanism extending through a connecting surface of either the back surface 204 or the bottom surface 206 or both surfaces of the package holder 102. A ratchet lock having a keyhole and/or a ratchet hinge with a tumbler lock activated switch may be used to lock the rungs 210 in place.

In other additional aspects of the package holder 102 according to one or more non-limiting embodiments, there may be a hook coupled to the package holder 102 that can be used to mount the package holder 102 over or under a door or other area of a property 128.

Advantageously, the accordion style arrangement of the rungs 210 provides a simpler storage container that can still effectively contain any stored items and/or packages 130 located within a package holder 102. In a non-limiting embodiment, the package holder 102 may not require smart, electronic locking mechanisms 110. Rather, the owner of the package holder 102 can raise the front cover 208 to await any deliveries. Once the third-party delivery service 134 or other party puts a package 130 within the interior of the package holder 102, a worker or another person can pull the set of rungs 210 of the front cover 208 over the package (in either an upwards or downwards direction depending on which direction the set of rungs are meant to be pulled in the embodiment) and the set of rungs will naturally fully expand to provide coverage together as a group over the package 130 and immediately lock in place in one or more non-limiting embodiments. This may be due to the inclusion of a ratchet lock. The owner of the package holder 102 may then ensure that the front cover 208 cannot be opened and stolen without the use of a key that the user/owner of the package holder 102 has in safekeeping.

For the package holder 102, one of the unique advantages provided is the collapsibility of the front cover 208. When not in use, the front cover 208 may be held in an upright, collapsed position and may be easily lowered if needed to store a delivered package 130 in the interior cavity 412 of the package holder 102. Accordingly, package holder 102 has a reduced profile that does not take up a great deal of space when the front cover 208 is fully collapsed in its raised position (e.g., as shown in FIG. 6) as opposed to the package holder 102 in its expanded position when the front cover 208 is in its fully lowered and expanded position as shown in the example in FIG. 10.

In an exemplary embodiment, one or more signs or mats can be positioned in front of or near the package holder 102 in order to clearly indicate to a delivery person where to locate or place the package 130. Such signs may include written text and/or images conveying to the delivery person where to locate the package 130 in the package holder 102. If there is a handle present, such as handle shown in FIG. 8 in order to lower the front cover 208. If there is a ratchet lock in place, the accordion style front cover 208 will automatically lock in place once the user fully lowers the front cover 208. A ratchet lock may be an example of a non-electronic locking mechanism 112.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, and steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted. The term "coupled to" as used herein may refer to a direct or indirect connection.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A package holder, comprising:

a frame structure having a back surface, a left side surface, a right side surface, and a front cover, the front cover further comprising:

a base platform;

a front cover left side;

a front cover right side;

a front cover front side;

a plurality of rungs connected together in a cascading, accordion style arrangement, wherein the front cover raises and lowers to reveal an interior cavity defined by the base platform, the front cover left side, the front cover right side, and the front cover front side, wherein the plurality of rungs as assembled raise and lower independently of the base platform; and at least one locking mechanism, wherein when the plurality of rungs fully cover the interior cavity of the package holder, the front cover is secured in place until the at least one locking mechanism is unlocked in order to raise or lower the front cover of the frame structure in order to expose the interior cavity of the package holder and/or to raise and or lower the plurality of rungs.

2. The package holder of claim 1, wherein the base platform is perpendicular to the front cover left side and front cover right side of the front cover of the package holder.

3. The package holder of claim 1, wherein the plurality of rungs of the front cover are configured to fit together in a collapsed position over each other between the front cover left side and the front cover right side of the front cover and behind or above the front cover front side of the front cover when the plurality of rungs are in the collapsed position.

4. The package holder of claim 1, wherein the package holder further is mountable to a physical surface of a property using one or more fasteners insertable into fastener holes positioned on the package holder.

5. The package holder of claim 1, wherein the at least one locking mechanism comprises a non-electronic locking mechanism.

6. The package holder of claim 5, wherein the non-electronic locking mechanism comprises a holder or a lock for receiving a physical key or includes a key code pad configured to receive a secure code.

7. The package holder of claim 1, wherein the at least one locking mechanism comprises an electronic locking mechanism triggered by a key fob, a key car, or an access code.

8. A method for electronically delivering and securing a package in a package holder, the method comprising:

providing a package holder, the package holder comprising:

a frame structure having a back surface, a left side surface, a right side surface, and a front cover, the front cover further comprising:

a base platform;

a front cover left side;

a front cover right side;

a front cover front side;

a plurality of rungs connected together in a cascading, accordion style arrangement, wherein the front cover raises and lowers to reveal an interior cavity defined by the base platform, the front cover left side, the front cover right side, and the front cover front side, wherein the plurality of rungs as assembled raise and lower independently of the base platform; and at least one locking mechanism, wherein when the plurality of rungs fully cover the interior cavity of the package holder, the front cover is secured in place until the at least one locking mechanism is unlocked in order to raise or lower the front cover of the frame structure in order to expose the interior cavity of the package holder and/or to raise and or lower the plurality of rungs;

one or more fasteners to fastenably mount the package holder to an exterior surface of a physical structure; and a tracking sensing system integrated into the package holder;

mounting and securely attaching the package holder to the exterior surface of the physical structure of a property using the one or more fasteners to fastenably mount the package holder;

receiving a signal intercepted by the tracking sensing system integrated into the package holder from an attached tracking tag attached to a package, wherein the package is located on a delivery vehicle of a third-party delivery service provider when the delivery vehicle of the third-party delivery service provider is within an operational range from the package holder;

upon the package and the attached tracking tag being within the operational range from the package holder, automatically unlocking the front cover of the package holder and automatically opening the front cover of the package holder;

receiving the package inside of the package holder, wherein a delivery person of the third-party delivery service provider deposits the package inside of the package holder after the front cover is automatically unlocked and automatically opened; and locking of the at least one locking mechanism and closing of the front cover to secure the package inside of the package holder.

9. The method of claim 8, wherein the at least one locking mechanism is an electronic locking mechanism and/or a computer operated locking mechanism.

10. The method of claim 9, wherein a separate non-electronic locking mechanism is integrated into the package holder in addition to the electronic locking mechanism and/or the computer operated locking mechanism and the separate non-electronic mechanism is lockable upon receiving the package inside of the package holder.

11. The method of claim 10, wherein the non-electronic locking mechanism is a lock having an associated key or a key pad.

12. The method of claim 8, wherein the at least one locking mechanism automatically lowers the front cover and locks the package holder.

13. The method of claim 8, wherein the package holder further comprises a biometric scanner separate from the at least one locking mechanism to receive a biometric identifier from the delivery person or another party in order to unlock the package holder or to lock the package holder.

14. The method of claim 8, further comprising, automatically locking the front cover of the package holder after a set period of time in which the front cover is unlocked and open.

15. The method of claim 8, wherein the mounting and the securely attaching the package holder to the exterior surface of the physical structure using the one or more fasteners to fastenably mount the package holder further comprises:

creating an opening in a wall surface behind a back surface of the package holder, wherein the opening in the wall surface provides exposure from an interior of a property into the interior cavity of the package holder from the interior of the property to access the package even when the package holder is mounted to the exterior surface of the physical structure of the property.

16. The method of claim 15, wherein a user is able to access the package from the interior of the property through the opening in the wall surface of the package holder.

* * * * *